US009752417B2

(12) United States Patent
Veit

(10) Patent No.: US 9,752,417 B2
(45) Date of Patent: Sep. 5, 2017

(54) GRAVEL PACKING APPARATUS HAVING OPTIMIZED FLUID HANDLING

(71) Applicant: Halliburton Energy Services, Inc., Houston, TX (US)

(72) Inventor: Jan Veit, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 298 days.

(21) Appl. No.: 14/484,539

(22) Filed: Sep. 12, 2014

(65) Prior Publication Data

US 2015/0129194 A1 May 14, 2015

(30) Foreign Application Priority Data

Nov. 14, 2013 (WO) ..... PCT/US2013/069997

(51) Int. Cl.
*E21B 43/08* (2006.01)
*E21B 43/04* (2006.01)

(52) U.S. Cl.
CPC ..... *E21B 43/088* (2013.01); *E21B 43/04* (2013.01)

(58) Field of Classification Search
None
See application file for complete search history.

(56) References Cited

U.S. PATENT DOCUMENTS 5,307,984 A * 5/1994 Nagaoka ..... B01D 29/15 166/233
5,515,915 A 5/1996 Jones et al.
6,343,651 B1 2/2002 Bixenman
2002/0053439 A1 5/2002 Danos
2002/0092649 A1 7/2002 Bixenman et al.
2003/0010496 A1 1/2003 McGregor
2009/0294128 A1 12/2009 Dale et al.

FOREIGN PATENT DOCUMENTS

WO 2005056978 A1 6/2005

OTHER PUBLICATIONS

Written Opinion issued by the Intellectual Property Office of Singapore regarding Singapore Patent Application No. 11201601400Y, dated Jun. 9, 2016, 6 pages.
Patent Examination Report No. 1 issued by IP Australia regarding Australian Patent Application No. 2013405210, dated Jun. 24, 2016, 4 pages.
Int'l Search Report and Written Opinion, KIPO, PCT/US2013/069997, Aug. 1, 2014.
Second Written Opinion issued by the Intellectual Property Office of Singapore regarding Singapore Patent Application No. 11201601400Y, dated Feb. 1, 6 pages.

* cited by examiner

*Primary Examiner* — Jennifer H Gay
*Assistant Examiner* — Caroline Butcher
(74) *Attorney, Agent, or Firm* — Haynes and Boone, LLP

(57) ABSTRACT

A gravel packing apparatus includes a base pipe having at least one opening in a sidewall portion thereof. A fluid filtration subassembly is positioned exteriorly of the base pipe and is in fluid communication with the at least one opening of the base pipe. The fluid filtration subassembly extends partially circumferentially around the base pipe and has at least two circumferential terminuses defining a circumferential gap therebetween. A slurry delivery subassembly is positioned exteriorly of the base pipe and at least partially within the circumferential gap.

19 Claims, 7 Drawing Sheets

GRAVEL PACKING APPARATUS HAVING OPTIMIZED FLUID HANDLING

CROSS-REFERENCE TO RELATED APPLICATIONS

This application claims the benefit under 35 U.S.C. §119 of the filing date of International Application No. PCT/US2013/069997, filed Nov. 14, 2013.

TECHNICAL FIELD OF THE DISCLOSURE

This disclosure relates, in general, to equipment utilized in conjunction with operations performed in relation to subterranean wells and, in particular, to a gravel packing apparatus having an improved slurry delivery subassembly and an improved production fluid filtration subassembly for optimized fluid handling.

BACKGROUND

Without limiting the scope of the present disclosure, its background is described with reference to a sand control completion in a wellbore traversing an unconsolidated or loosely consolidated subterranean formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate may cause abrasive wear to components within the well. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use tubing positioned exteriorly along the length of the sand control screens to provide an alternate path for the fluid slurry around potential sand bridges. It has been found, however, that due to the desire to maximize the production flow path within the tubing string for a given production interval borehole size, that limited space exists for the alternate path components. Therefore, a need has arisen for an apparatus for gravel packing a production interval that overcomes the problems associated with sand bridges. In addition, a need has arisen for such an apparatus for gravel packing a production interval that overcomes the problems associated with limited space for the alternate path components.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION OF THE DISCLOSURE

Figure 1:
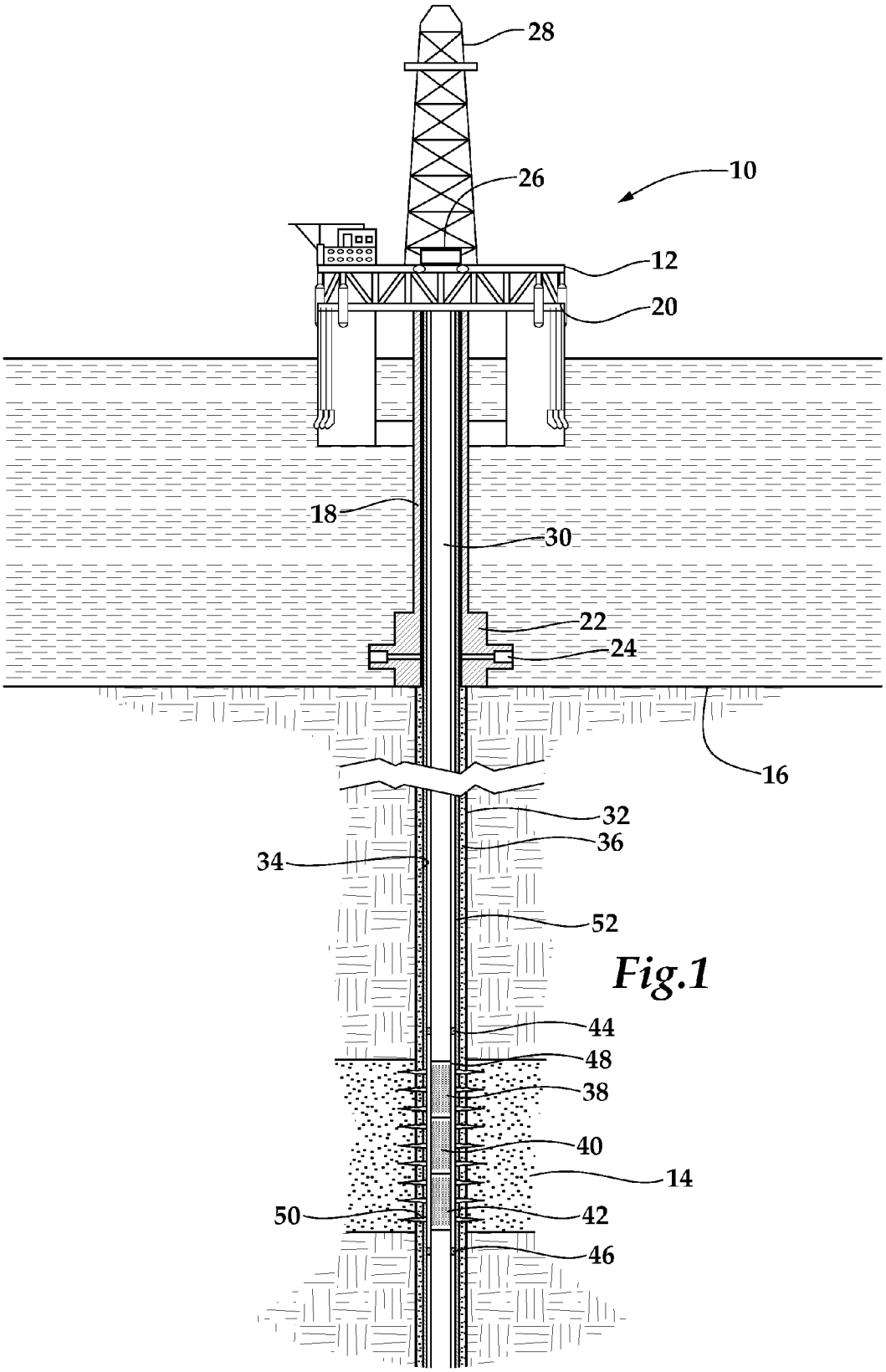
FIG. 1 is a schematic illustration of an offshore platform operating a gravel packing apparatus having optimized fluid handling according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

The present disclosure is directed to a gravel packing apparatus having an improved slurry delivery subassembly and an improved production fluid filtration subassembly for optimized fluid handling. The gravel packing apparatus of the present disclosure is operable to overcome the problems associated with sand bridges. In addition, the gravel packing apparatus of the present disclosure is operable to overcome the problems associated with limited space for the alternate path components.

In a first aspect, the present disclosure is directed to a gravel packing apparatus. The gravel packing apparatus includes a base pipe having at least one opening in a sidewall portion thereof. A fluid filtration subassembly is positioned exteriorly of the base pipe and in fluid communication with the at least one opening of the base pipe. The fluid filtration subassembly extends partially circumferentially around the base pipe having at least two circumferential terminuses defining a circumferential gap therebetween. A slurry delivery subassembly is positioned exteriorly of the base pipe and at least partially within the circumferential gap.

In at least one embodiment, the fluid filtration subassembly may include at least first and second partially circumferentially extending filter media. In this embodiment, the circumferential gap may be defined between a circumferential terminus of the first filter medium and a circumferential terminus of the second filter medium. In some embodiments, the fluid filtration subassembly may include at least first and second axially distributed filter media. In certain embodiments, an outer shroud may be positioned exteriorly of the fluid filtration subassembly and the slurry delivery subassembly. In at least one embodiment, the slurry delivery subassembly may include at least one transport tube and at least one packing tube having at least one slurry delivery nozzle. In these embodiments, the at least one transport tube and the at least one packing tube may have rectangular cross sections or may have non-rectangular cross sections such as oval cross sections, kidney cross sections, arched cross sections or the like. In some embodiments, the slurry delivery subassembly may include at least two transport tubes and at least two packing tubes each having at least one slurry delivery nozzle. In certain embodiments, the fluid filtration subassembly may have at least four circumferential terminuses defining first and second circumferential gaps therebetween. In these embodiments, a first portion of the slurry delivery subassembly may be at least partially positioned within the first circumferential gap and a second portion of the slurry delivery subassembly may be at least partially positioned within the second circumferential gap.

In a second aspect, the present disclosure is directed to a gravel packing apparatus. The gravel packing apparatus includes a base pipe having a plurality of openings in a sidewall portion thereof. A fluid filtration subassembly is positioned exteriorly of the base pipe. The fluid filtration subassembly includes at least first and second partially circumferentially extending filter media each in fluid communication with at least one of the openings of the base pipe. The first filter medium has a first circumferential terminus and the second filter medium has a second circumferential terminus such that the first and second circumferential terminuses define a circumferential gap therebetween. A slurry delivery subassembly is positioned exteriorly of the base pipe and at least partially within the circumferential gap.

In a third aspect, the present disclosure is directed to a gravel packing apparatus. The gravel packing apparatus includes a base pipe having at least one opening in a sidewall portion thereof. A fluid filtration subassembly is positioned exteriorly of the base pipe and in fluid communication with the at least one opening of the base pipe. The fluid filtration subassembly extends partially circumferentially around the base pipe having at least two circumferential terminuses defining a circumferential gap therebetween. A slurry delivery subassembly is positioned exteriorly of the base pipe and at least partially within the circumferential gap. The slurry delivery subassembly includes at least two transport tubes and at least two packing tubes each having at least one slurry delivery nozzle.

Referring initially to FIG. 1, a gravel packing apparatus positioned in an interval of a wellbore and operating from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is secured within wellbore 32 by cement 36. Work string 30 includes various tools such as joints 38, 40, 42 that form the gravel packing apparatus of the present disclosure that is positioned in a production interval of wellbore 32 adjacent to formation 14 between packers 44, 46. When it is desired to gravel pack annular region 48 surrounding joints 38, 40, 42, a fluid slurry including a liquid carrier and a particulate material such as sand, gravel or proppant is pumped down work string 30.

Some or all of the fluid slurry is typically injected directly into annular region 48 in a known manner, such as through a crossover tool (not pictured), which allows the slurry to travel from the interior of work string 30 to the exterior of work string 30. Once the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of joints 38, 40, 42 filling those sections with gravel. The sand control screens within joints 38, 40, 42 disallows further migration of the gravel but allows the liquid carrier to travel therethrough into work string 30 and up to the surface via annulus 52. If sand bridges form in annular region 48, some or all of the fluid slurry is injected or diverted into the slurry delivery subassemblies within and connected between joints 38, 40, 42 to bypass the sand bridges such that a complete pack can be achieved.

Even though FIG. 1 depicts the gravel packing apparatus of the present disclosure in a vertical wellbore, it should be understood by those skilled in the art that the gravel packing apparatus of the present disclosure is equally well suited for use in wellbores having other directional configurations including horizontal wellbores, deviated wellbores, slanted wellbores, multilateral wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be noted by one skilled in the art that the gravel packing apparatus of the present disclosure is equally well suited for use in onshore operations. Further, even though FIG. 1 depicts the gravel packing apparatus of the present disclosure as having a particular number of joints, it should be understood by those skilled in the art that a gravel packing apparatus of the present disclosure may have any number of joints both less than or greater than the number shown.

Figure 2:
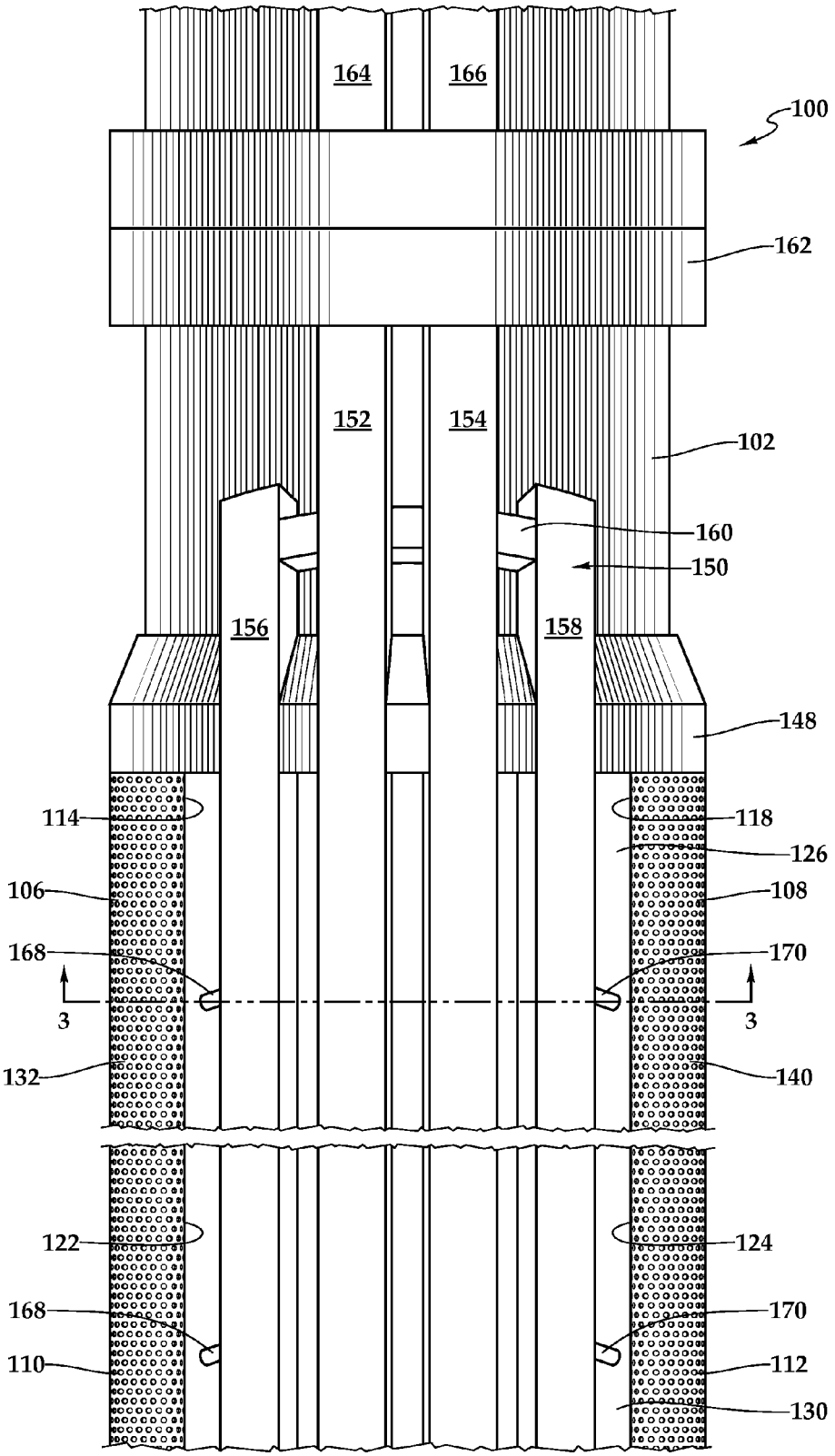
FIG. 2 is a side view of a gravel packing apparatus having optimized fluid handling according to an embodiment of the present disclosure.
Figure 3:
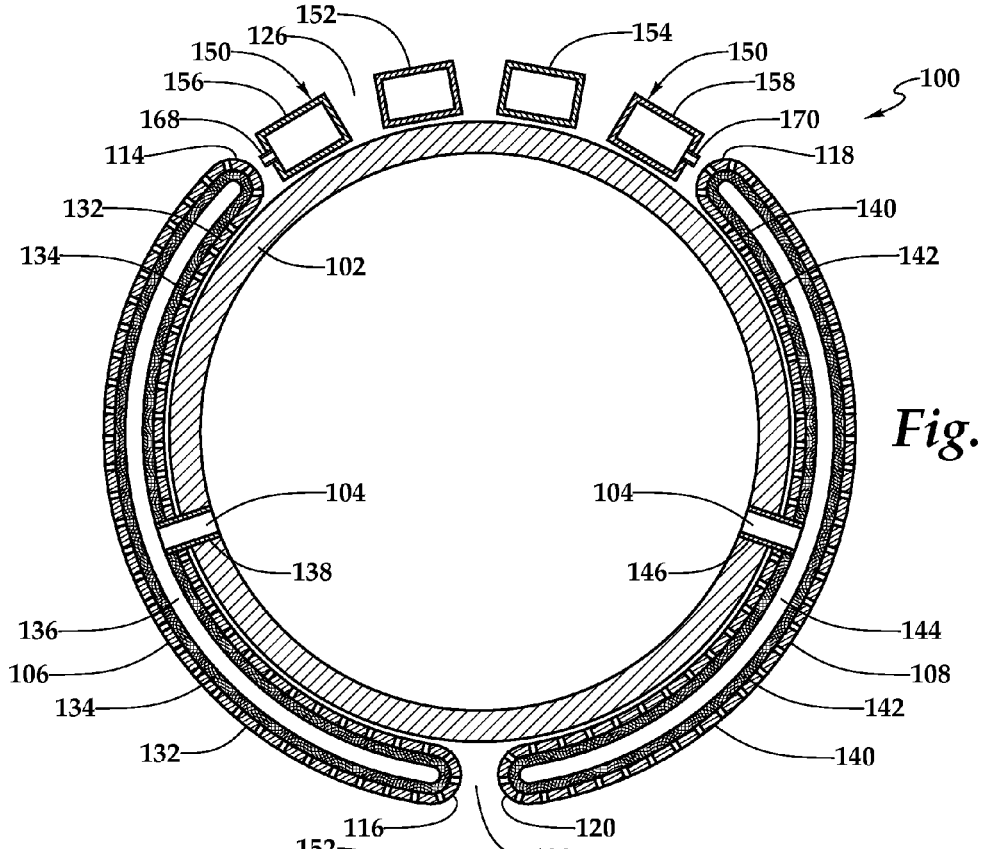
FIG. 3 is a cross sectional view of a gravel packing apparatus having optimized fluid handling according to an embodiment of the present disclosure.

Referring next to FIGS. 2 and 3, therein is depicted a gravel packing apparatus of the present disclosure that is generally designated 100. Apparatus 100 has a base pipe 102 that includes a plurality of openings 104 that are preferably distributed circumferentially around and axially along the length of base pipe 102 (only two openings being visible in FIG. 3), which allow the flow of production fluids therethrough. Disposed exteriorly of base pipe 102 is a production fluid filtration subassembly depicted as a plurality of sand control screen assemblies or filter media 106, 108, 110, 112. As illustrated, filter media 106, 108, 110, 112 each extend partially circumferentially around base pipe 102. Filter media 106, 108 are circumferentially distributed around base pipe 102 relative to each other. Filter media 110, 112 are circumferentially distributed around base pipe 102 relative to each other. Filter media 106, 110 are axially distributed along base pipe 102 relative to each other. Filter media 108, 112 are axially distributed along base pipe 102 relative to each other. In the illustrated embodiment, filter medium 106 includes a circumferential terminus 114 and a circumferential terminus 116. Likewise, filter medium 108 includes a circumferential terminus 118 and a circumferential terminus 120. Visible in FIG. 2, filter medium 110 includes a circumferential terminus 122 and filter medium 112 includes a circumferential terminus 124. As filter media 106, 108 do not extend entirely around base pipe 102, a circumferential gap 126 is defined between circumferential terminus 114 of filter medium 106 and circumferential terminus 118 of filter medium 108. Visible in FIG. 3, a circumferential gap 128 is defined between circumferential terminus 116 of filter medium 106 and circumferential terminus 120 of filter medium 108. Visible in FIG. 2, a circumferential gap 130 is defined between circumferential terminus 122 of filter medium 110 and circumferential terminus 124 of filter medium 112.

In the illustrated embodiment, filter media 106, 108, 110, 112 each include a fluid-porous, particulate restricting wire mesh screen designed to allow fluid flow therethrough but prevent the flow of particulate materials of a predetermined size from passing therethrough. The screens preferably have a plurality of layers of wire mesh including one or more drainage layers and one or more filter layers wherein the drainage layers have a mesh size that is larger than the mesh size of the filter layers. For example, a drainage layer may preferably be positioned as the outermost layer and the innermost layer of wire mesh screen with the filter layer or layers positioned therebetween. Positioned around the screens are screen wrappers that have a plurality of openings which allow the flow of production fluids therethrough. The exact number, size and shape of openings is not critical to the present disclosure, so long as sufficient area is provided for fluid production and the integrity of screen wrapper is maintained. Typically, various sections of screen and screen wrapper are manufactured together as a unit by, for example, diffusion bonding or sintering the layers of wire mesh that form the screen together with the screen wrapper, then rolling the unit into a tubular configuration. The two ends of the tubular unit are then seam welded together. The tubular unit is then shaped into the illustrated arch form, preferably maintaining a gap between outer and inner screen sections.

As best seen in FIG. 3, filter media 106 includes screen wrapper 132 and screen 134, each of which have a radially inner portion and a radially outer portion relative to base pipe 102. An inner region 136 is defined between the radially inner and outer portions of screen 134. In the illustrated embodiment, a radial space exists between the outer surface of base pipe 102 and the inner surface of screen wrapper 132 allowing fluid flow therebetween. All fluid produced into filter media 106 must first travel through screen wrapper 132, then screen 134 before entering inner region 136. In the illustrated embodiment, fluid may enter filter media 106 from the radially inner or radially outer side thereof. One or more flow tubes 138 provide fluid communication between inner region 136 and base pipe 102 via openings 104. Similarly, filter media 108 includes screen wrapper 140 and screen 142, each of which have a radially inner portion and a radially outer portion relative to base pipe 102. An inner region 144 is defined between the radially inner and outer portions of screen 142. All fluid produced into filter media 108 must first travel through screen wrapper 140 then screen 142 before entering inner region 144. One or more flow tubes 146 provide fluid communication between inner region 144 and base pipe 102 via openings 104. In the illustrated embodiment, filter media 106, 108, 110, 112 are attached to base pipe 102 using screen support rings, such as screen support ring 148 that is visible in FIG. 2, and that are preferably welded to base pipe 102.

Extending axially along and to the exterior of base pipe 102 a slurry delivery subassembly 150. In the illustrated embodiment, slurry delivery subassembly 150 is positioned within circumferential gap 126 between circumferential terminus 114 of filter medium 106 and circumferential terminus 118 of filter medium 108 as well as within circumferential gap 130 between circumferential terminus 122 of filter medium 110 and circumferential terminus 124 of filter medium 130. In this configuration, slurry delivery subassembly 150 is adjacent to or substantially adjacent to base pipe 102. As illustrated, slurry delivery subassembly 150 includes a pair of transport tubes 152, 154, a pair of packing tubes 156, 158 and a manifold 160 or other fluid distribution means that provides fluid communication between transport tubes 152, 154 and packing tubes 156, 158. Transport tubes 152, 154 and packing tubes 156, 158 are received within channels in screen support ring 148 as well as the other similar screen support rings (not pictured). As illustrated, transport tubes 152, 154 extend axially into a transport tube support ring 162 that is preferably welded to base pipe 102. Transport tube support ring 162 allows transport tubes 152, 154 to be fluidically coupled to the transport tubes 152, 154 of another joint via jumper tubes 164, 166 that extend between joints. Packing tubes 156, 158 each include a plurality of axially distributed nozzles, such as nozzles 168 of packing tube 156 and nozzles 170 of packing tube 158. In the event of sand bridge formation or as part of the planned gravel packing process, some or all of the fluid slurry is injected into the slurry delivery subassembly 150 of the uppermost joint. The fluid slurry is able to travel from one joint to the next via transport tubes 152, 154 and jumper tubes 164, 166. As the fluid slurry travels from joint to joint, portions of the fluid slurry enter packing tubes 156, 158 via manifold 160. From packing tubes 156, 158, the fluid slurry is able to enter the annular region surrounding gravel packing apparatus 100 by exiting slurry delivery subassembly 150 via nozzles 168, 170. In this manner, a complete gravel pack may be achieved even if sand bridges form in the annular region surrounding gravel packing apparatus 100.

As best seen in FIG. 3, by positioning slurry delivery subassembly 150 within circumferential gap 126 between filter media 106, 108, gravel packing apparatus 100 has a larger filter surface, a larger production fluid flow path and a larger flow path for slurry delivery than in conventionally designed gravel packing apparatuses. For example, in conventional design, the slurry delivery subassembly would be positioned to the exterior of the filter media which results in either a smaller base pipe, smaller transport/packing tubes or both. Also, use of the arch shaped filter media having radially inner and outer surfaces instead of a convention concentric filter media adds addition filter surface area for production fluids to access. In this manner, gravel packing apparatus 100 has been optimized for fluid handling.

Figure 4:
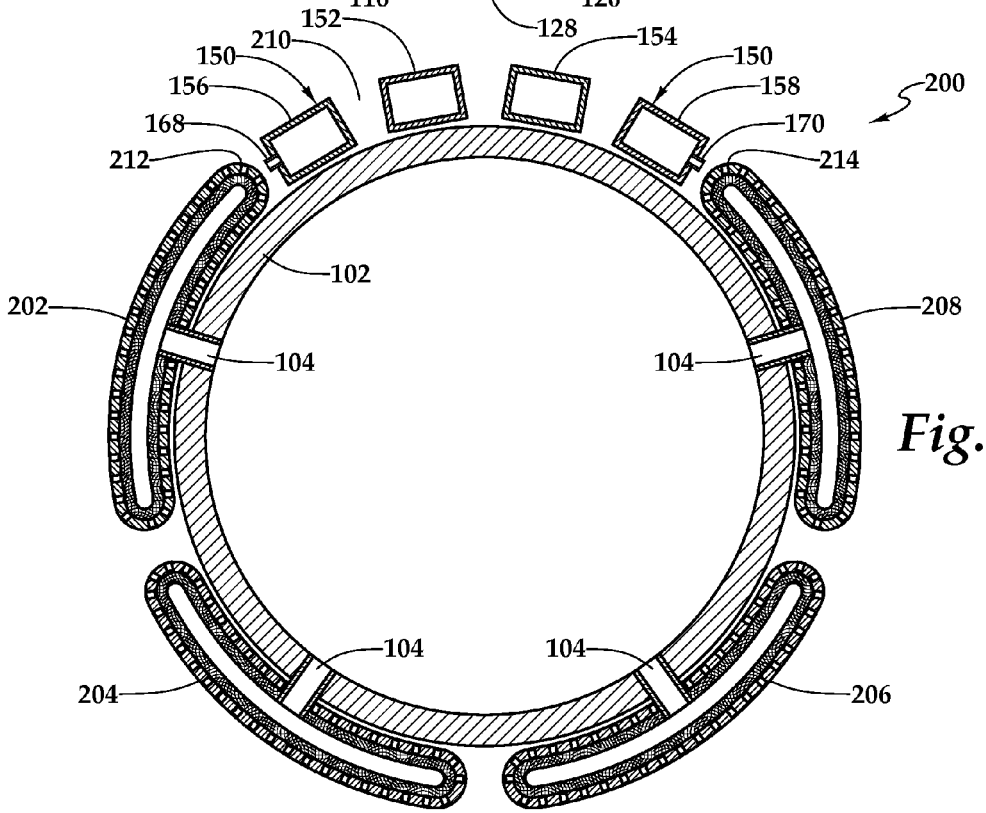
FIG. 4 is a cross sectional view of a gravel packing apparatus having optimized fluid handling according to an embodiment of the present disclosure.

It should be understood by those skilled in the art that even though FIGS. 2 and 3 have described a gravel packing apparatus having filter media of a particular design, gravel packing apparatuses having filter media with other designs could alternatively be used in conjunction with the apparatus of the present disclosure. For example, as best seen in FIG. 4, a gravel packing apparatus 200 is depicted having four circumferentially distributed a filter media. Specifically, gravel packing apparatus 200 includes filter media 202, 204, 206, 208 each of which have a screen wrapper, a screen and an inner region similar to the filter media described above such that all fluid produced into filter media 202, 204, 206, 208 must first travel through a screen wrapper, then a screen before entering an inner region. Each filter media is in fluid communication with base pipe 102 via one or more openings 104 through one or more flow tubes in a manner similar to that described above.

Extending axially along and to the exterior of base pipe 102 a slurry delivery subassembly 150. In the illustrated embodiment, slurry delivery subassembly 150 is positioned within a circumferential gap 210 between circumferential terminus 212 of filter medium 202 and circumferential terminus 214 of filter medium 208. Slurry delivery subassembly 150 includes a pair of transport tubes 152, 154 and a pair of packing tubes 156, 158 each including a plurality of axially distributed nozzles, such as nozzles 168 of packing tube 156 and nozzles 170 of packing tube 158. By positioning slurry delivery subassembly 150 within circumferential gap 210 between filter media 202, 208, gravel packing apparatus 200 has a larger filter surface, a larger production fluid flow path and a larger flow path for slurry delivery than conventionally designed gravel packing apparatuses. In this manner, gravel packing apparatus 200 has been optimized for fluid handling.

Figure 5:
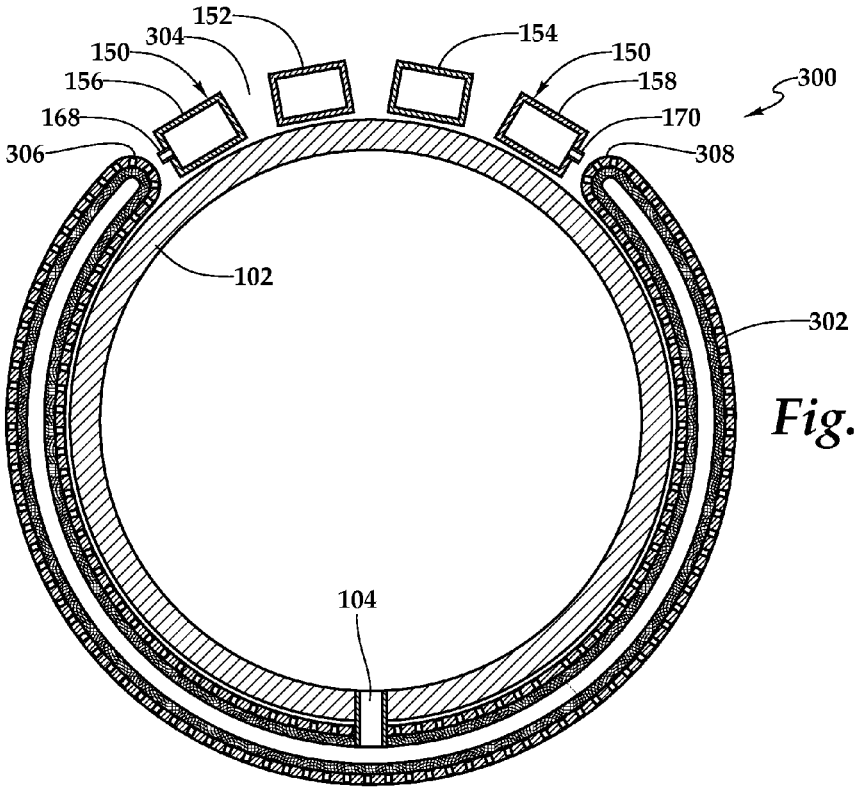
FIG. 5 is a cross sectional view of a gravel packing apparatus having optimized fluid handling according to an embodiment of the present disclosure.

In another example, as best seen in FIG. 5, a gravel packing apparatus 300 is depicted having a single circumferentially extending filter medium. Specifically, gravel packing apparatus 300 includes filter medium 302 having a screen wrapper, a screen and an inner region similar to the filter media described above such that all fluid produced into filter medium 302 must first travel through the screen wrapper, then the screen before entering the inner region. Filter medium 302 is in fluid communication with base pipe 102 via one or more openings 104 through one or more flow tubes in a manner similar to that described above. Extending axially along and to the exterior of base pipe 102 a slurry delivery subassembly 150. In the illustrated embodiment, slurry delivery subassembly 150 is positioned within a circumferential gap 304 between circumferential terminus 306 and circumferential terminus 308 of filter medium 302. Slurry delivery subassembly 150 includes a pair of transport tubes 152, 154 and a pair of packing tubes 156, 158 each including a plurality of axially distributed nozzles, such as nozzles 168 of packing tube 156 and nozzles 170 of packing tube 158. By positioning slurry delivery subassembly 150 within circumferential gap 304 of filter media 302, gravel packing apparatus 300 has a larger filter surface, a larger production fluid flow path and a larger flow path for slurry delivery than conventionally designed gravel packing apparatuses. In this manner, gravel packing apparatus 300 has been optimized for fluid handling.

Figure 6:
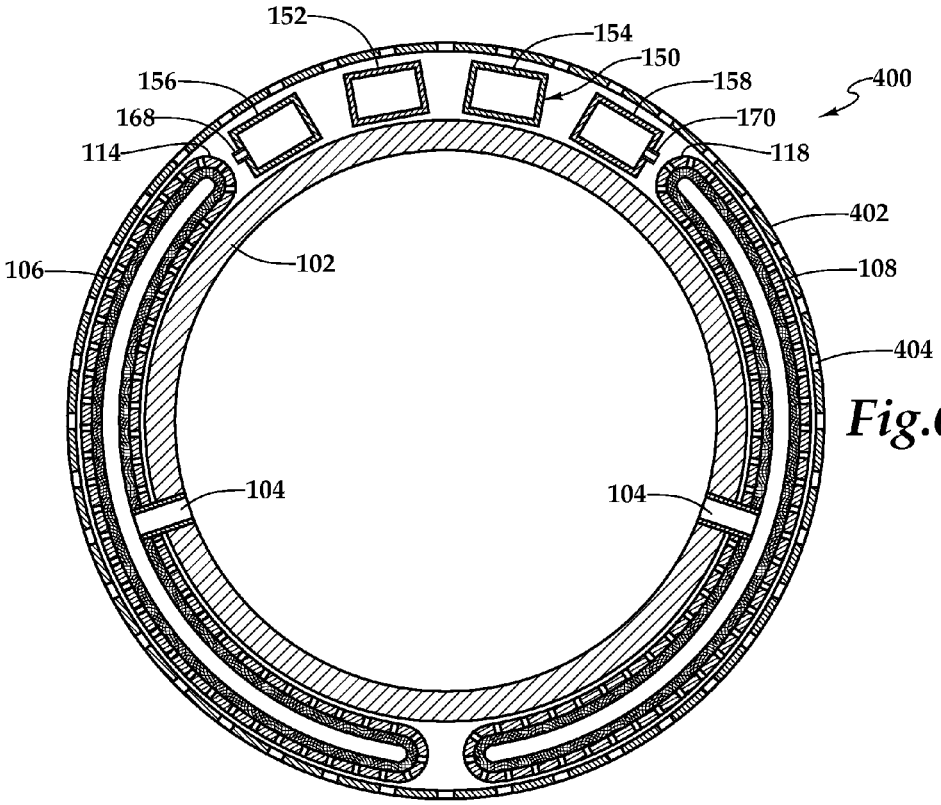
FIG. 6 is a cross sectional view of a gravel packing apparatus having optimized fluid handling according to an embodiment of the present disclosure.

It should be understood by those skilled in the art that even though FIGS. 2-5 have described gravel packing apparatuses having the fluid filtration subassembly and the slurry delivery subassembly as the outermost elements of the gravel packing apparatuses, other designs could alternatively be used in conjunction with the apparatus of the present disclosure. For example, as best seen in FIG. 6, therein is depicted gravel packing apparatus 400 having the base pipe 102, filter media 106, 108 and slurry delivery subassembly 150 as described above but also having a protective outer shroud 402 positioned exteriorly therearound. As illustrated, outer shroud 402 includes a plurality of opening 404 to allow fluid communication therethrough including slurry delivery and formation fluid production.

Figure 7:
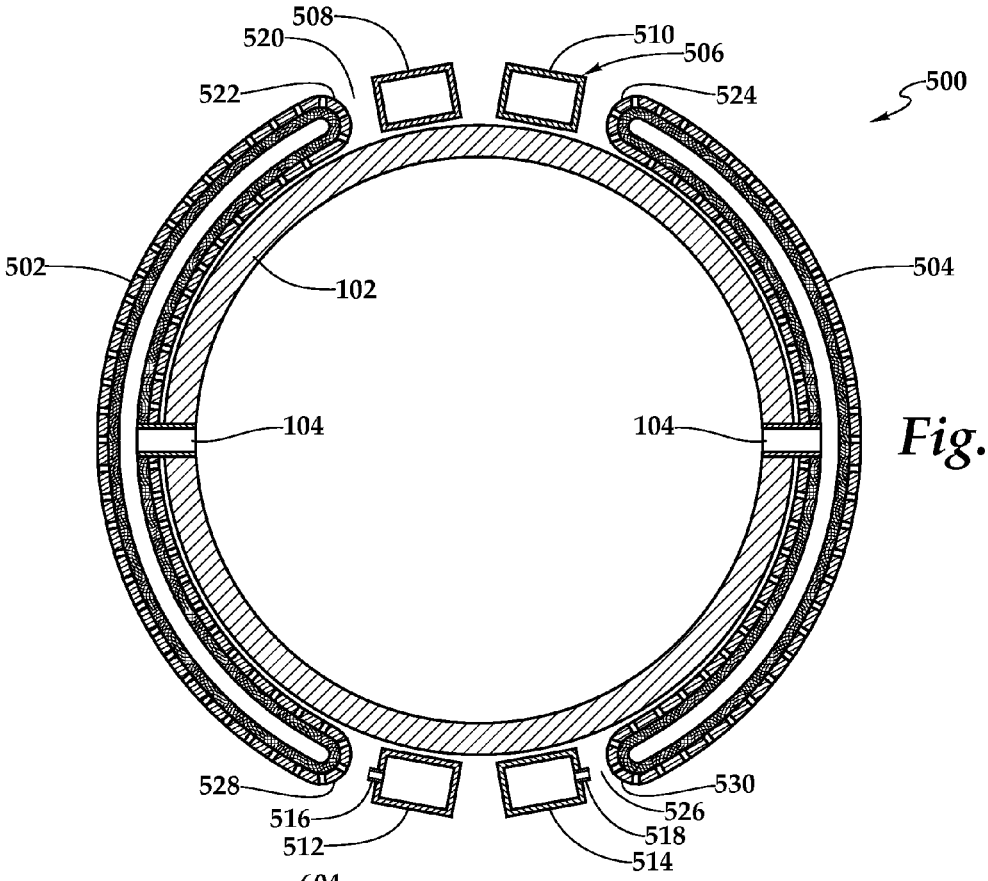
FIG. 7 is a cross sectional view of a gravel packing apparatus having optimized fluid handling according to an embodiment of the present disclosure.

It should be understood by those skilled in the art that even though FIGS. 2-6 have described a gravel packing apparatus having a slurry delivery subassembly of a particular design, gravel packing apparatuses having slurry delivery subassemblies with other designs could alternatively be used in conjunction with the apparatus of the present disclosure. For example, as best seen in FIG. 7, portions of the slurry delivery subassembly are positioned in separate circumferential gaps between filter media. Specifically, gravel packing apparatus 500 includes filter media 502, 504 each of which have a screen wrapper, a screen and an inner region similar to the filter media described above such that all fluid produced into filter media 502, 504 must first travel through a screen wrapper, then a screen before entering an inner region. Each filter media is in fluid communication with base pipe 102 via one or more openings 104 through one or more flow tubes in a manner similar to that described above. Extending axially along and to the exterior of base pipe 102 a slurry delivery subassembly 506. Slurry delivery subassembly 506 includes a pair of transport tubes 508, 510 and a pair of packing tubes 512, 514 each including a plurality of axially distributed nozzles, such as nozzles 516 of packing tube 512 and nozzles 518 of packing tube 514. A manifold or other fluid distribution means (not visible in FIG. 7) provides fluid communication between transport tubes 508, 510 and packing tubes 512, 514. In the illustrated embodiment, transport tubes 508, 510 are positioned within a circumferential gap 520 between circumferential terminus 522 of filter medium 502 and circumferential terminus 524 of filter medium 504. Packing tubes 512, 514 are positioned within a circumferential gap 526 between circumferential terminus 528 of filter medium 502 and circumferential terminus 530 of filter medium 504. By positioning slurry delivery subassembly 506 within circumferential gaps 520, 526 between filter media 502, 504, gravel packing apparatus 500 has a larger filter surface, a larger production fluid flow path and a larger flow path for slurry delivery than conventionally designed gravel packing apparatuses. In this manner, gravel packing apparatus 500 has been optimized for fluid handling.

Figure 8:
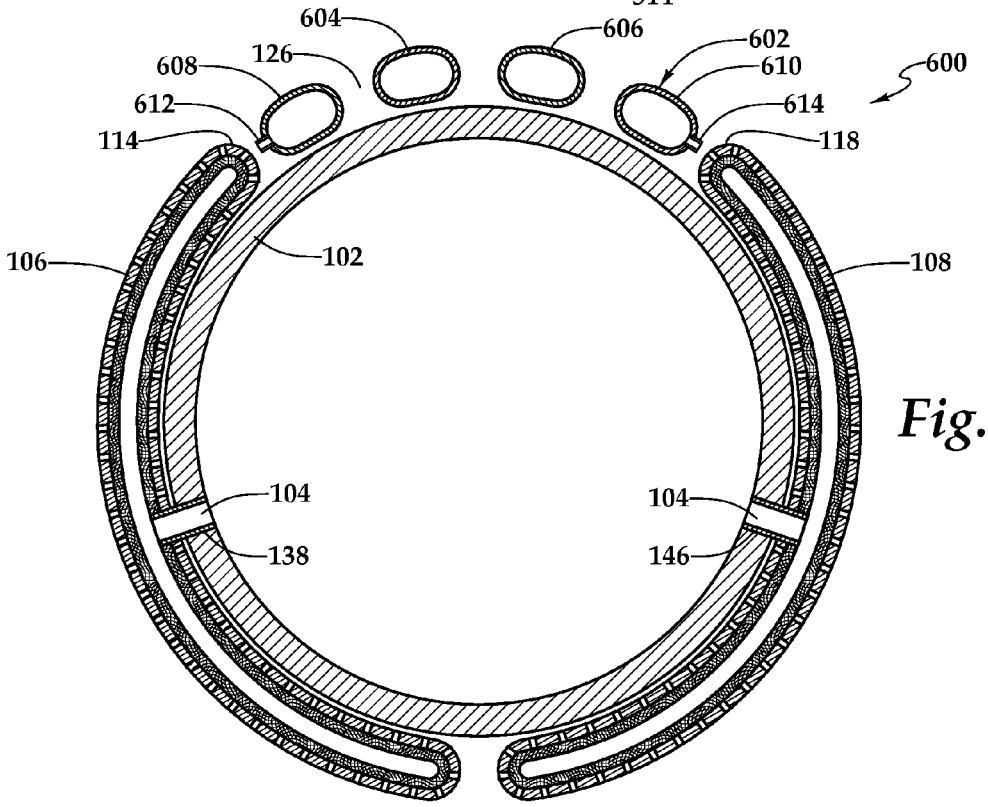
FIG. 8 is a cross sectional view of a gravel packing apparatus having optimized fluid handling according to an embodiment of the present disclosure.

In another example, as best seen in FIG. 8, a gravel packing apparatus 600 is depicted having a slurry delivery subassembly wherein the transport tubes and packing tubes have a non-rectangular cross section. Specifically, gravel packing apparatus 600 includes filter media 106, 108 each having a screen wrapper, a screen and an inner region as described above such that all fluid produced into filter media 106, 108 must first travel through a screen wrapper, then a screen before entering an inner region. Each filter media is in fluid communication with base pipe 102 via one or more openings 104 through one or more flow tubes 138, 146 as described above. Extending axially along and to the exterior of base pipe 102 a slurry delivery subassembly 602. Slurry delivery subassembly 602 includes a pair of transport tubes 604, 606 and a pair of packing tubes 608, 610 each including a plurality of axially distributed nozzles, such as nozzles 612 of packing tube 608 and nozzles 614 of packing tube 610. In the illustrated embodiment, transport tubes 604, 606 and packing tubes 608, 610 have oval cross sections which may reduce certain fluid losses as slurry is pumped therethrough. In the illustrated embodiment, slurry delivery subassembly 602 is positioned within circumferential gap 126 between circumferential terminus 114 of filter medium 106 and circumferential terminus 118 of filter medium 108. By positioning slurry delivery subassembly 602 within circumferential gap 126 between filter media 106, 108, and through the use of oval shaped tubes, gravel packing apparatus 600 has a larger filter surface, a larger production fluid flow path and a larger flow path for slurry delivery than conventionally designed gravel packing apparatuses. In this manner, gravel packing apparatus 600 has been optimized for fluid handling.

Figure 9:
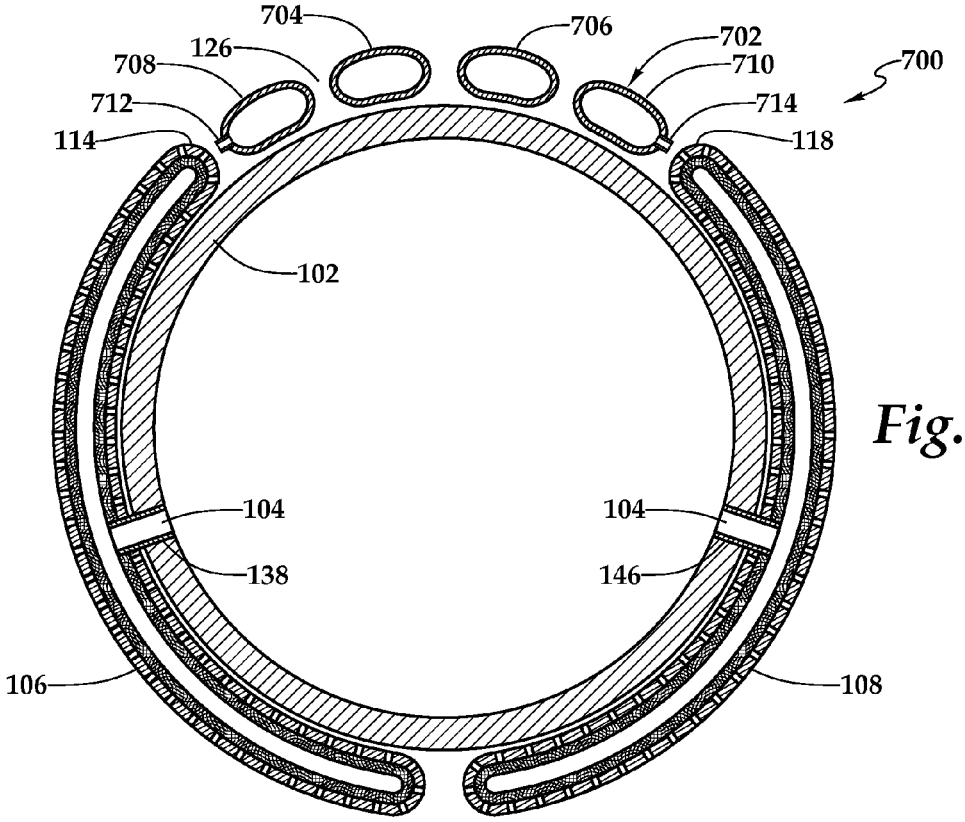
FIG. 9 is a cross sectional view of a gravel packing apparatus having optimized fluid handling according to an embodiment of the present disclosure.

As another example, as best seen in FIG. 9, a gravel packing apparatus 700 is depicted having a slurry delivery subassembly wherein the transport tubes and packing tubes have a non-rectangular cross section. Specifically, gravel packing apparatus 700 includes filter media 106, 108 each having a screen wrapper, a screen and an inner region as described above such that all fluid produced into filter media 106, 108 must first travel through a screen wrapper, then a screen before entering an inner region. Each filter media is in fluid communication with base pipe 102 via one or more openings 104 through one or more flow tubes 138, 146 as described above. Extending axially along and to the exterior of base pipe 102 a slurry delivery subassembly 702. Slurry delivery subassembly 702 includes a pair of transport tubes 704, 706 and a pair of packing tubes 708, 710 each including a plurality of axially distributed nozzles, such as nozzles 712 of packing tube 708 and nozzles 714 of packing tube 710. In the illustrated embodiment, transport tubes 704, 706 and packing tubes 708, 710 have kidney shaped cross sections which may reduce certain fluid losses as slurry is pumped therethrough. In the illustrated embodiment, slurry delivery subassembly 702 is positioned within circumferential gap 126 between circumferential terminus 114 of filter medium 106 and circumferential terminus 118 of filter medium 108. By positioning slurry delivery subassembly 702 within circumferential gap 126 between filter media 106, 108, and through the use of kidney shaped tubes, gravel packing apparatus 700 has a larger filter surface, a larger production fluid flow path and a larger flow path for slurry delivery than conventionally designed gravel packing apparatuses. In this manner, gravel packing apparatus 700 has been optimized for fluid handling.

Figure 10:
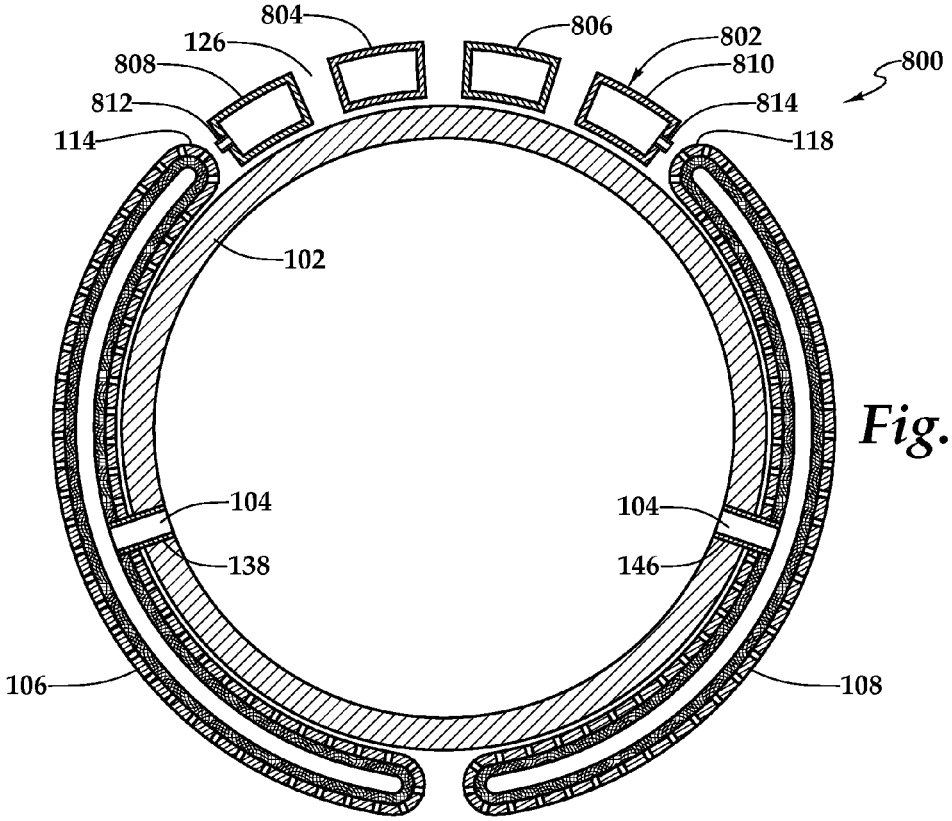
FIG. 10 is a cross sectional view of a gravel packing apparatus having optimized fluid handling according to an embodiment of the present disclosure.

In a further example, as best seen in FIG. 10, a gravel packing apparatus 800 is depicted having a slurry delivery subassembly wherein the transport tubes and packing tubes have a non-rectangular cross section. Specifically, gravel packing apparatus 800 includes filter media 106, 108 each having a screen wrapper, a screen and an inner region as described above such that all fluid produced into filter media 106, 108 must first travel through a screen wrapper, then a screen before entering an inner region. Each filter media is in fluid communication with base pipe 102 via one or more openings 104 through one or more flow tubes 138, 146 as described above. Extending axially along and to the exterior of base pipe 102 a slurry delivery subassembly 802. Slurry delivery subassembly 802 includes a pair of transport tubes 804, 806 and a pair of packing tubes 808, 810 each including a plurality of axially distributed nozzles, such as nozzles 812 of packing tube 808 and nozzles 814 of packing tube 810. In the illustrated embodiment, transport tubes 804, 806 and packing tubes 808, 810 have arch shaped cross sections which may reduce certain fluid losses as slurry is pumped therethrough. In the illustrated embodiment, slurry delivery subassembly 802 is positioned within circumferential gap 126 between circumferential terminus 114 of filter medium 106 and circumferential terminus 118 of filter medium 108. By positioning slurry delivery subassembly 802 within circumferential gap 126 between filter media 106, 108, and through the use of arch shaped tubes, gravel packing apparatus 800 has a larger filter surface, a larger production fluid flow path and a larger flow path for slurry delivery than conventionally designed gravel packing apparatuses. In this manner, gravel packing apparatus 800 has been optimized for fluid handling.

Figure 11:
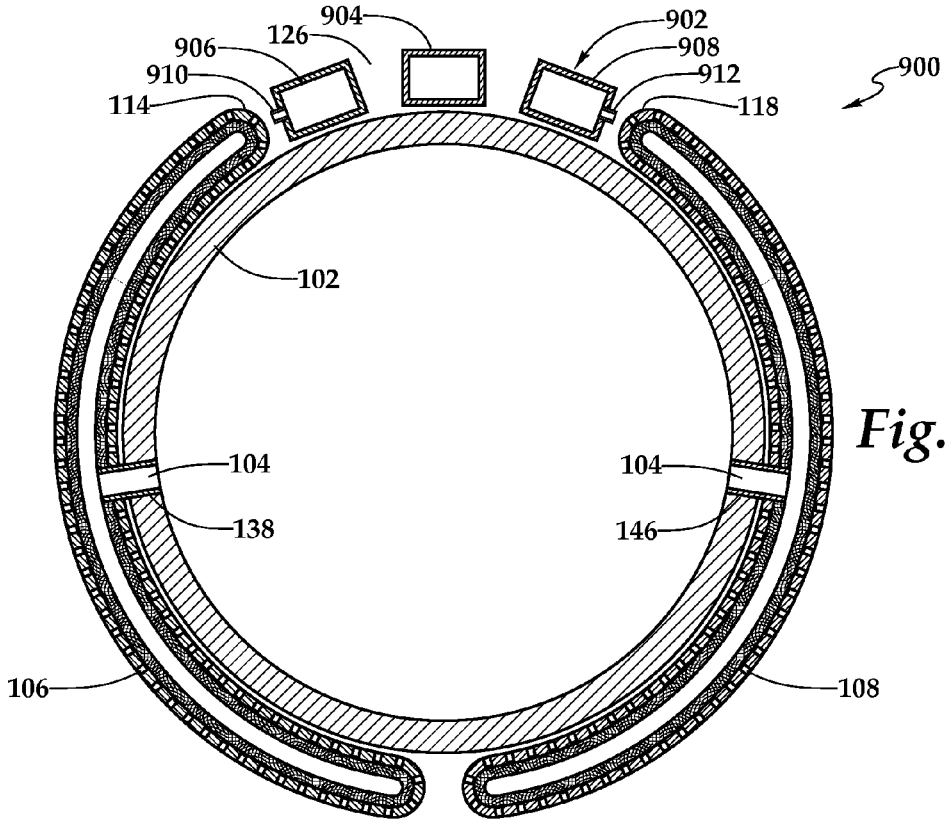
FIG. 11 is a cross sectional view of a gravel packing apparatus having optimized fluid handling according to an embodiment of the present disclosure.

It should be understood by those skilled in the art that even though FIGS. 2-10 have described a gravel packing apparatus having a slurry delivery subassembly of a particular design, gravel packing apparatuses having slurry delivery subassemblies with other designs could alternatively be used in conjunction with the apparatus of the present disclosure. For example, as best seen in FIG. 11, a gravel packing apparatus 900 is depicted having a slurry delivery subassembly 902 including a single transport tube 904 and a pair of packing tubes 906, 908 each having a plurality of nozzles 910, 912. In the illustrated embodiment, slurry delivery subassembly 902 is positioned within circumferential gap 126 between circumferential terminus 114 of filter medium 106 and circumferential terminus 118 of filter medium 108. By positioning slurry delivery subassembly 902 within circumferential gap 126 between filter media 106, 108, gravel packing apparatus 900 has a larger filter surface, a larger production fluid flow path and a larger flow path for slurry delivery than conventionally designed gravel packing apparatuses. In this manner, gravel packing apparatus 900 has been optimized for fluid handling.

Figure 12:
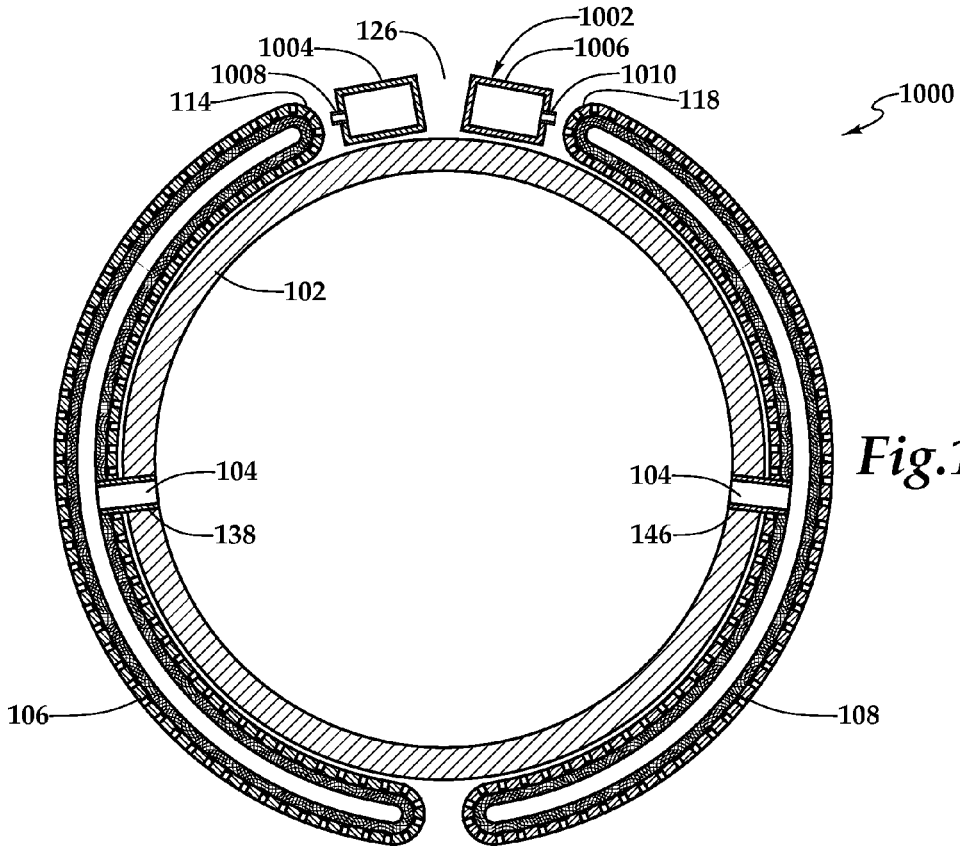
FIG. 12 is a cross sectional view of a gravel packing apparatus having optimized fluid handling according to an embodiment of the present disclosure.

In another example, as best seen in FIG. 12, a gravel packing apparatus 1000 is depicted having a slurry delivery subassembly 1002 including a pair of slurry delivery tubes 1004, 1006 that serve as both transport tubes, as they extend from joint to joint, as well as packing tubes, as each has a plurality of nozzles 1008, 1010. In the illustrated embodiment, slurry delivery subassembly 1002 is positioned within circumferential gap 126 between circumferential terminus 114 of filter medium 106 and circumferential terminus 118 of filter medium 108. By positioning slurry delivery subassembly 1002 within circumferential gap 126 between filter media 106, 108, gravel packing apparatus 1000 has a larger filter surface, a larger production fluid flow path and a larger flow path for slurry delivery than conventionally designed gravel packing apparatuses. In this manner, gravel packing apparatus 1000 has been optimized for fluid handling.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A gravel packing apparatus comprising:

a base pipe forming an interior fluid passageway and having at least one opening in a sidewall portion thereof;

a fluid filtration subassembly positioned exteriorly of the base pipe and in fluid communication with the interior fluid passageway of the base pipe via the at least one opening, the fluid filtration subassembly extending partially circumferentially around the base pipe having at least two circumferential terminuses defining a circumferential gap therebetween;

wherein the fluid filtration subassembly further comprises a first partially circumferentially extending filter medium and a second partially circumferentially extending filter medium;

wherein the circumferential gap is defined between a circumferential terminus of the first filter medium and a circumferential terminus of the second filter medium;

wherein the first filter medium comprises a screen layer forming an outermost layer of the first filter medium relative to the base pipe and an innermost layer of the first filter medium relative to the base pipe; and wherein the outermost layer of the first filter medium is radially spaced from the innermost layer of the first filter medium to define an inner region of the first filter medium;

a tube accommodated in the at least one opening and extending through an opening in the innermost layer of the first filter medium to place the inner region of the first filter medium in fluid communication with the interior fluid passageway of the base pipe; and a slurry delivery subassembly positioned exteriorly of the base pipe and at least partially within the circumferential gap.

2. The gravel packing apparatus as recited in claim 1 wherein the first partially circumferentially extending filter medium and the second partially circumferentially extending filter medium are axially distributed relative to a longitudinal axis of the base pipe.

3. The gravel packing apparatus as recited in claim 1 further comprising an outer shroud positioned exteriorly of the fluid filtration subassembly and the slurry delivery subassembly.

4. The gravel packing apparatus as recited in claim 1 wherein the slurry delivery subassembly further comprises at least one transport tube and at least one packing tube having at least one slurry delivery nozzle.

5. The gravel packing apparatus as recited in claim 4 wherein the at least one transport tube and the at least one packing tube have rectangular cross sections.

6. The gravel packing apparatus as recited in claim 4 wherein the at least one transport tube and the at least one packing tube have non-rectangular cross sections.

7. The gravel packing apparatus as recited in claim 4 wherein the at least one transport tube and the at least one packing tube have cross sections selected from the group consisting of oval, kidney and arched.

8. The gravel packing apparatus as recited in claim 1 wherein the slurry delivery subassembly further comprises at least two transport tubes and at least two packing tubes each having at least one slurry delivery nozzle.

9. The gravel packing apparatus as recited in claim 1 wherein the fluid filtration subassembly has at least four circumferential terminuses defining first and second circumferential gaps therebetween and wherein a first portion of the slurry delivery subassembly is at least partially positioned within the first circumferential gap and a second portion of the slurry delivery subassembly is at least partially positioned within the second circumferential gap.

10. A gravel packing apparatus comprising:

a base pipe forming an interior fluid passageway and having a plurality of openings in a sidewall portion thereof;

a fluid filtration subassembly positioned exteriorly of the base pipe, the fluid filtration subassembly including:

first and second partially circumferentially extending filter media each in fluid communication with the interior fluid passageway of the base pipe via at least one of the openings, the first filter medium having a first circumferential terminus and the second filter medium having a second circumferential terminus such that the first and second circumferential terminuses define a circumferential gap therebetween;

wherein the first filter medium comprises a first screen layer forming an outermost layer of the first filter medium relative to the base pipe and an innermost layer of the first filter medium relative to the base pipe;

wherein the outermost layer of the first filter medium is radially spaced from the innermost layer of the first filter medium to define an inner region of the first filter medium;

wherein the second filter medium comprises a second screen layer forming an outermost layer of the second filter medium relative to the base pipe and an innermost layer of the second filter medium relative to the base pipe; and wherein the outermost layer of the second filter medium is radially spaced from the innermost layer of the second filter medium to define an inner region of the second filter medium;

a first tube accommodated in a first opening of the plurality of openings and extending through an opening in the innermost layer of the first filter medium to place the inner region of the first filter medium in fluid communication with the interior fluid passageway of the base pipe; and a second tube accommodated in a second opening of the plurality of openings and extending through an opening in the innermost layer of the second filter medium to place the inner region of the second filter medium in fluid communication with the interior fluid passageway of the base pipe; and a slurry delivery subassembly positioned exteriorly of the base pipe and at least partially within the circumferential gap.

11. The gravel packing apparatus as recited in claim 10 further comprising an outer shroud positioned exteriorly of the fluid filtration subassembly and the slurry delivery subassembly.

12. The gravel packing apparatus as recited in claim 10 wherein the slurry delivery subassembly further comprises at least one transport tube and at least one packing tube having at least one slurry delivery nozzle.

13. The gravel packing apparatus as recited in claim 12 wherein the at least one transport tube and the at least one packing tube have cross sections selected from the group consisting of rectangular, oval, kidney and arched.

14. The gravel packing apparatus as recited in claim 10 wherein the fluid filtration subassembly has at least four circumferential terminuses defining first and second circumferential gaps therebetween and wherein a first portion of the slurry delivery subassembly is at least partially positioned within the first circumferential gap and a second portion of the slurry delivery subassembly is at least partially positioned within the second circumferential gap.

15. The gravel packing apparatus as recited in claim 10, wherein a radial space exists between an outer surface of the base pipe and an inner surface of the innermost layer of the first filter medium; and wherein a fluid enters into the first filter medium from the radial space.

16. A gravel packing apparatus comprising:

a base pipe forming an interior fluid passageway and having at least one opening in a sidewall portion thereof;

a fluid filtration subassembly positioned exteriorly of the base pipe and in fluid communication with the interior fluid passageway of the base pipe via the at least one opening, the fluid filtration subassembly extending partially circumferentially around the base pipe having at least two circumferential terminuses defining a circumferential gap therebetween;

wherein the fluid filtration subassembly further comprises a first partially circumferentially extending filter medium and a second partially circumferentially extending filter medium;

wherein the circumferential gap is defined between a circumferential terminus of the first filter medium and a circumferential terminus of the second filter medium;

wherein the first filter medium comprises a screen layer forming an outermost layer of the first filter medium relative to the base pipe and an innermost layer of the first filter medium relative to the base pipe; and wherein the outermost layer of the first filter medium is radially spaced from the innermost layer of the first filter medium to define an inner region of the first filter medium;

a tube accommodated in the at least one opening and extending through an opening in the innermost layer of the first filter medium to place the inner region of the first filter medium in fluid communication with the interior fluid passageway of the base pipe;

wherein a radial space exists between an outer surface of the base pipe and an inner surface of the innermost layer of the first filter medium;

wherein a fluid enters into the first filter medium from the radial space; and a slurry delivery subassembly positioned exteriorly of the base pipe and at least partially within the circumferential gap, the slurry delivery subassembly including at least two transport tubes and at least two packing tubes each having at least one slurry delivery nozzle.

17. The gravel packing apparatus as recited in claim 16 further comprising an outer shroud positioned exteriorly of the fluid filtration subassembly and the slurry delivery subassembly.

18. The gravel packing apparatus as recited in claim 16 wherein the transport tubes and the packing tubes have cross sections selected from the group consisting of rectangular, oval, kidney and arched.

19. The gravel packing apparatus as recited in claim 16 wherein the fluid filtration subassembly has at least four circumferential terminuses defining first and second circumferential gaps therebetween and wherein the transport tubes are at least partially positioned within the first circumferential gap and the packing tubes are at least partially positioned within the second circumferential gap.

* * * * *